US008905797B2

(12) United States Patent
Wu et al.

(10) Patent No.: US 8,905,797 B2
(45) Date of Patent: Dec. 9, 2014

(54) ELECTRICAL CONNECTOR

(75) Inventors: Jianfeng Wu, Shanghai (CN); Zhenyu Chen, Shanghai (CN); Lihao Liu, Shanghai (CN); Yuanchun Chen, Shanghai (CN); Feirong Zhou, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 13/475,309

(22) Filed: May 18, 2012
(Under 37 CFR 1.47)

(65) Prior Publication Data

US 2014/0154931 A1 Jun. 5, 2014

(30) Foreign Application Priority Data

May 19, 2011 (CN) ..... 2011 2 0166203

(51) Int. Cl.
*H01R 13/436* (2006.01)

(52) U.S. Cl.
CPC ..... *H01R 13/4367* (2013.01)
USPC ..... 439/752

(58) Field of Classification Search
USPC ..... 439/752, 595
See application file for complete search history.

(56) References Cited

U.S. PATENT DOCUMENTS

| | | | | |
|---|---|---|---|---|
| 5,454,740 | A * | 10/1995 | Sakano et al. | 439/752 |
| 7,090,543 | B2 * | 8/2006 | Lee et al. | 439/752 |
| 2001/0005657 | A1 * | 6/2001 | Kashiyama | 439/752 |
| 2002/0013105 | A1 * | 1/2002 | Kashiyama | 439/752 |
| 2006/0110989 | A1 * | 5/2006 | Lee et al. | 439/752 |

* cited by examiner

*Primary Examiner* — Gary Paumen
(74) *Attorney, Agent, or Firm* — Barley Snyder

(57) ABSTRACT

An electrical connector includes a housing, a first terminal, and a first lock. The housing includes a first receiving chamber and first recess positioned adjacent to the first receiving chamber. The first terminal is insertable into the first receiving chamber. The lock is securable to the housing and includes a horizontal base plate, a first pressing rod extending downward from the horizontal base plate and insertable into the first receiving chamber to press against the first terminal, and a first rotation prevention member extending downward from the horizontal base plate and insertable into the first recess to mate with the recess in a substantially gapless manner.

25 Claims, 6 Drawing Sheets

ELECTRICAL CONNECTOR

CROSS-REFERENCE TO RELATED APPLICATION

This application claims priority under 35 U.S.C. §119 to Chinese Patent Application No. 201120166203.X filed on May 19, 2011.

FIELD OF THE INVENTION

The invention relates to an electrical connector and, more particularly, to an electrical connector for transmitting electric power or an electrical signal.

BACKGROUND

A known electrical connector generally includes a housing and a terminal disposed in the housing. A cable is inserted into the housing and electrically connected to the terminal. If the cable is pulled from the housing, the terminal may be loosened from the housing. Accordingly, it is necessary to firmly secure the terminal in the housing.

In order to firmly secure the terminal in the housing, a known lock has been developed. The known lock is snapped to the housing and press against an end of the terminal to prevent the terminal from being disengaged from the housing.

The cable is inserted into the housing through a cable passage formed in the lock device, however, the cables for the electrical connector may have different diameters. Accordingly, the cable passage of the known lock must be adapted to various cables with different diameters. Furthermore, the cable passage of the known lock has a constant diameter, and the constant diameter must be adapted for the cable having a largest diameter among the various cables.

When a cable having a smaller diameter is used to pass through the cable passage of the known lock device, there is a larger gap between the cable passage having the constant diameter and the cable having the smaller diameter. Accordingly, when the cable having the smaller diameter is pulled outward, the known lock may easily rotate or offset with respect to an axis of the cable passage and generate a larger moment of force on the known lock device. When the pulling force exerted on the known lock using the cable reaches a certain value, a locking piece of the lock snapped to the housing may be broken down. Once the known lock is damaged, the cable and the terminal may be loosened from the housing of the electrical connector when pulled, and the electrical connector may fail.

SUMMARY

The invention has been made to overcome or alleviate at least one aspect of the above mentioned disadvantages.

An electrical connector, according to the invention, includes a housing, a first terminal, and a first lock. The housing includes a first receiving chamber and first recess positioned adjacent to the first receiving chamber. The first terminal is insertable into the first receiving chamber. The lock is securable to the housing and includes a horizontal base plate, a first pressing rod extending downward from the horizontal base plate and insertable into the first receiving chamber to press against the first terminal, and a first rotation prevention member extending downward from the horizontal base plate and insertable into the first recess to mate with the recess in a substantially gapless manner.

BRIEF DESCRIPTION OF THE DRAWINGS

The above and other features of the invention will become more apparent by describing in detail illustrative embodiments thereof with reference to the accompanying drawings, in which.

DETAILED DESCRIPTION OF THE EMBODIMENT(S)

Figure 1:
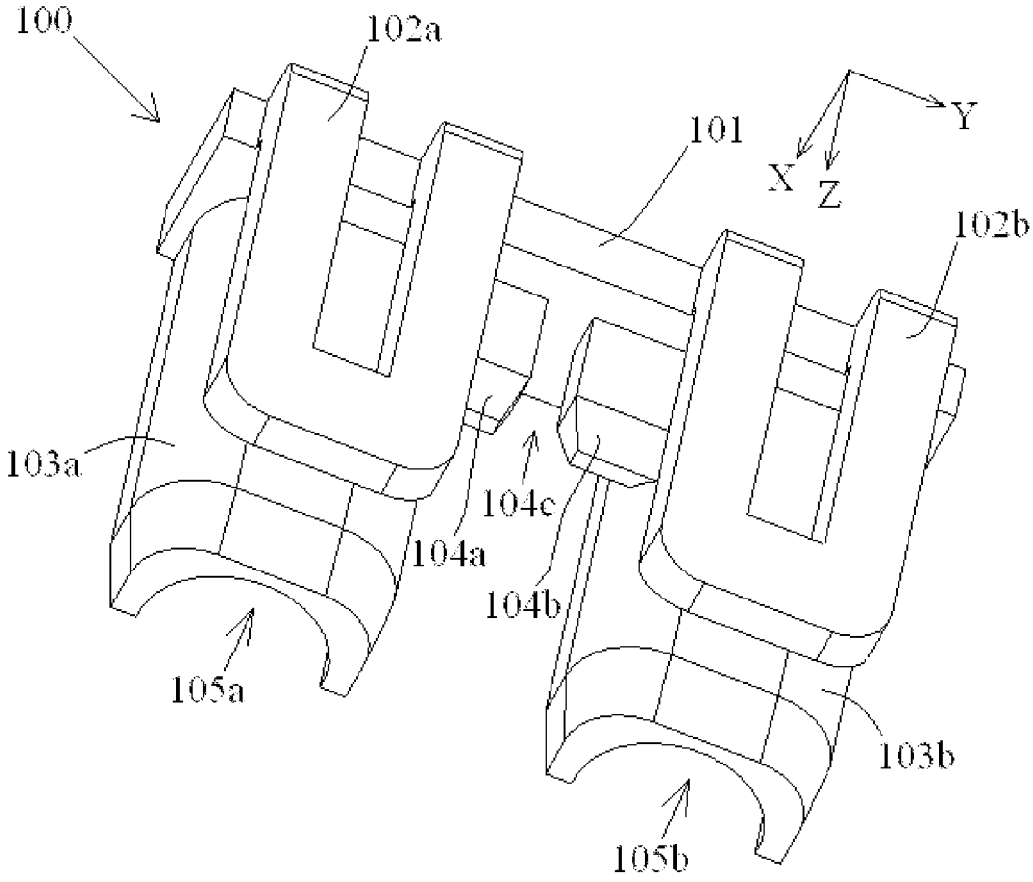
FIG. 1 is a perspective view of a lock of an electrical connector according to the invention.

Various embodiments of the disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the disclosure will be thorough and complete, and will fully convey the concept of the disclosure to those skilled in the art.

As shown in FIG. 1, a lock 100 generally includes a horizontal base plate 101, two pressing rods 103*a*, 103*b*, two locking pieces 102*a*, 102*b*, and two rotation prevention members 104*a*, 104*b*.

The horizontal base plate 101 extends in a longitudinal direction Y shown in FIG. 1. The two pressing rods 103*a*, 103*b* are integrally connected to the horizontal base plate 101 and extend downward in a substantially vertical direction Z shown in FIG. 1 from the horizontal base plate 101. The two pressing rods 103*a*, 103*b* are inserted into two receiving chambers 203*a*, 203*b* of the housing 200 shown in FIG. 2, respectively, and press against the respective terminals 300*a*, 300*b* (see FIGS. 3-4) to secure the terminals 300*a*, 300*b* in the housing 200.

In the shown embodiment, the pressing rods 103*a*, 103*b* have a semi-cylinder shape and each is formed with a semi-circular cable passage 105*a*, 105*b* through which a cable is introduced into the housing 200 and electrically connected with one terminal 300*a* or 300*b*. However, please be noted that the invention is not limited to this, the pressing rods 103*a*, 103*b* may be formed in other shapes, such as elliptic, rectangular, etc.

Referring to FIG. 1, the two locking pieces 102*a*, 102*b* are connected to the horizontal base plate 101 and extend downward in the vertical direction Z shown in FIG. 1 from the horizontal base plate 101. The two locking pieces 102*a*, 102*b* are snapped into two slots 202*a*, 202*b* of the housing 200 shown in FIG. 2, respectively.

As shown in FIG. 1, one pressing rod 103*a* and one locking piece 102*a* are arranged at one longitudinal side of the horizontal base plate 101 and separated from each other. The other pressing rod 103*b* and the other locking piece 102*b* are arranged at the other longitudinal side of the horizontal base plate 101 and separated from each other.

Please refer to FIG. 1, one rotation prevention member 104*a* is located between one pressing rod 103*a* and one locking piece 102*a*, while another rotation prevention member 104*b* is located between the other pressing rod 103*b* and the other locking piece 102*b*.

Although the lock 100 has two pressing rods 103*a*, 103*b*, two locking pieces 102*a*, 102*b*, and two rotation prevention members 104*a*, 104*b* in the embodiment shown, the invention is not limited to this. Rather, the lock 100 may has only one pressing rod, one locking piece, and one rotation prevention member, or three or more pressing rods, three or more locking pieces, and three or more rotation prevention members.

Figure 2:
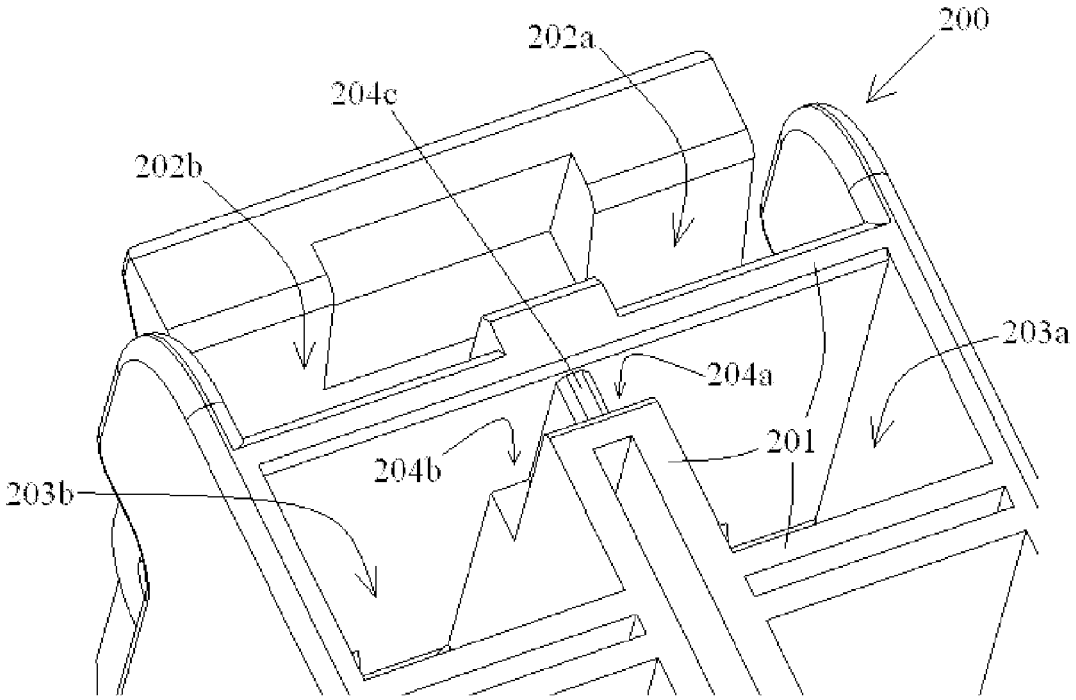
FIG. 2 is a perspective view of a housing that mates with the lock of the electrical connector shown in FIG. 1.
Figure 3:
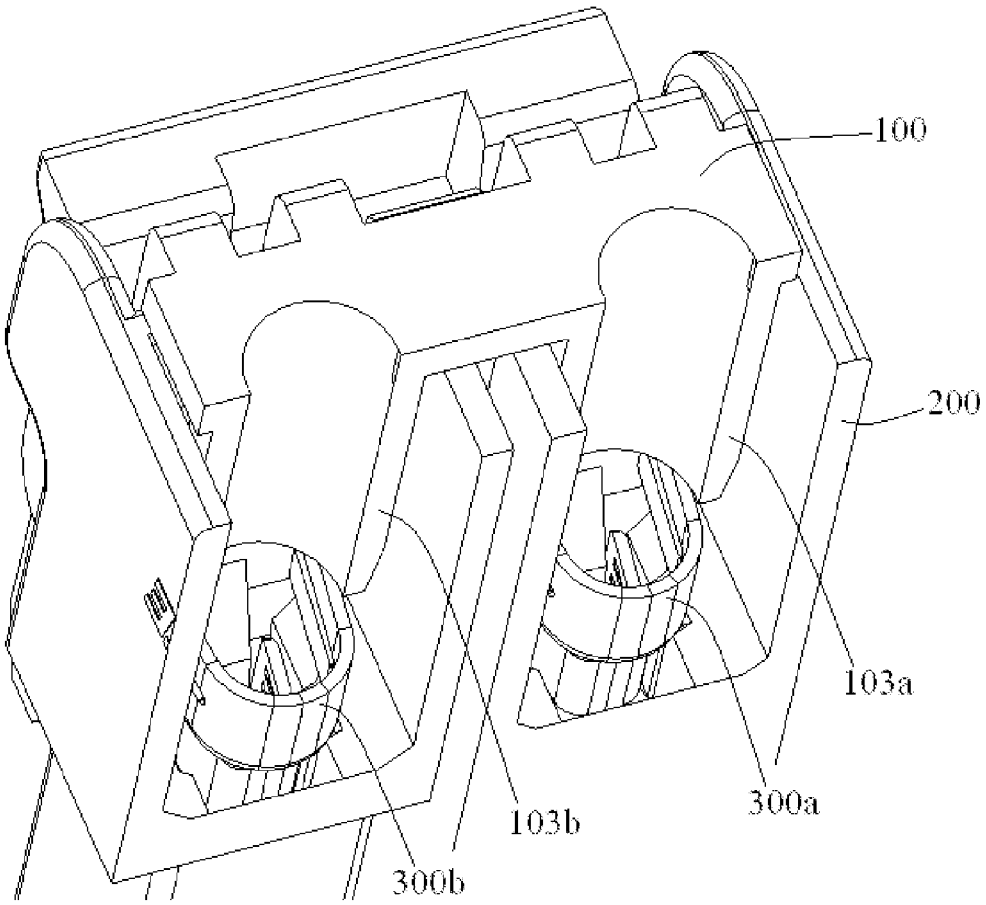
FIG. 3 is a perspective sectional view of the lock of FIG. 1 and the housing of FIG. 2 that are snapped together.
Figure 4:
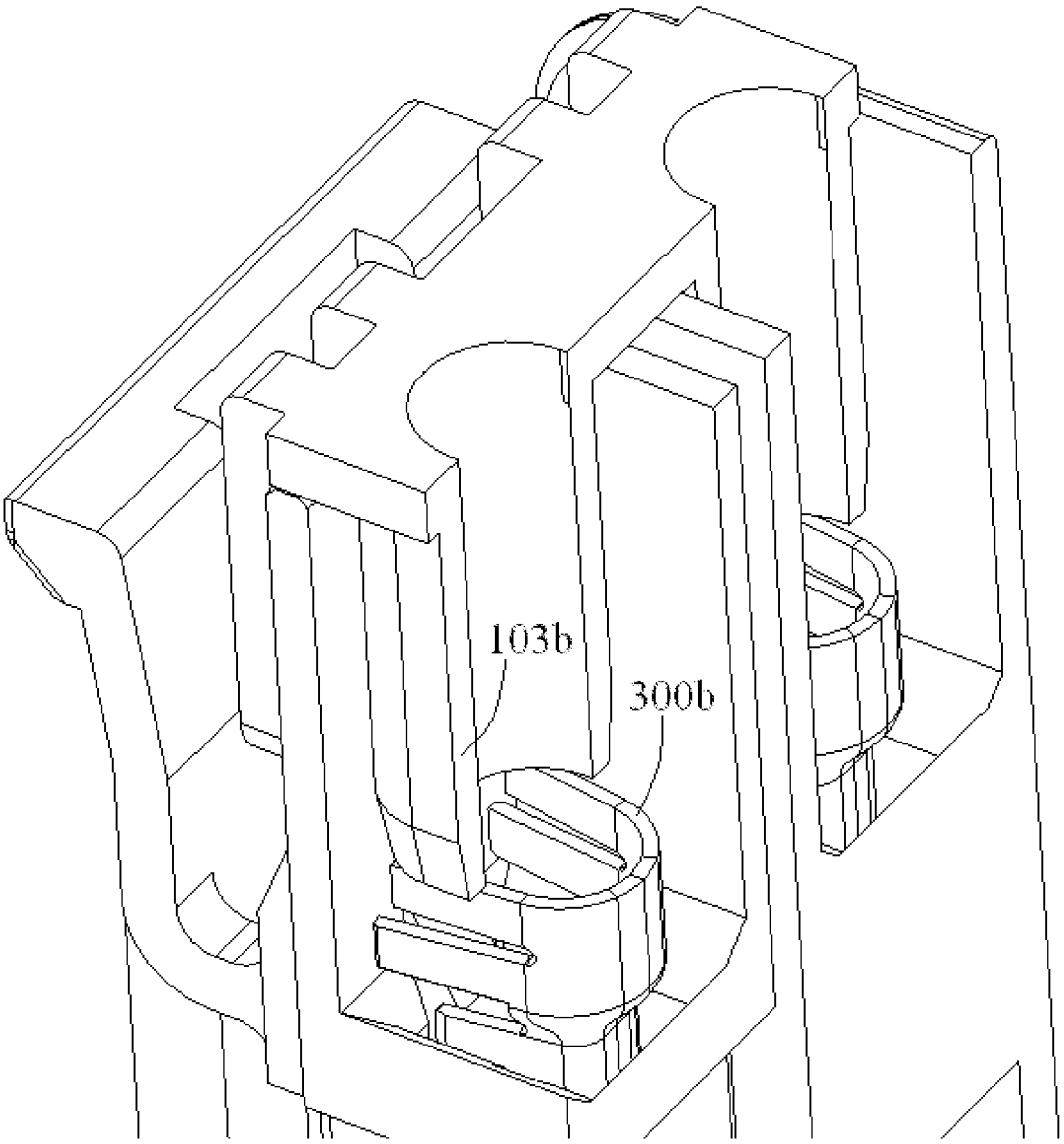
FIG. 4 is an enlarged sectional view of the housing and the lock that are snapped together, showing a terminal in the housing.

As shown in FIGS. 2-4, the housing 200 includes chambers 203*a*, 203*b* positioned side-by-side, and recesses 204*a*, 204*b* positioned between the chambers 203*a*, 203*b* and separated by a wall 204*c*. Each recess 204*a*, 204*b* includes a pair of facing wall surfaces 201*a*, 201*b*, which are substantially parallel to the longitudinal direction Y and the vertical direction Z. The chambers 203*a*, 203*b* can receive the two terminals 300*a*, 300*b*, respectively, and external cables (not shown) are inserted through the cable passages 105*a*, 105*b* of the lock 100 into the housing 200 and electrically connected to the terminals 300*a*, 300*b*.

Referring to FIGS. 3-6, the lock 100 is securable to the housing 200 in a snap-fit manner. The two pressing rods 103*a*, 103*b* of the lock 100 are insertable into the receiving chambers 203*a*, 203*b* of the housing 200 and press against ends of the terminals 300*a*, 300*b*, so that the terminals 300*a*, 300*b* are firmly secured in the housing 200. Each rotation prevention members 104*a*, 104*b* is received by the recesses 204*a*, 204*b*, such that the rotation prevention members 104*a*, 104*b* are positioned between the pair of facing wall surfaces 201*a*, 201*b* in a substantially gapless or tightly contact manner.

Figure 6:
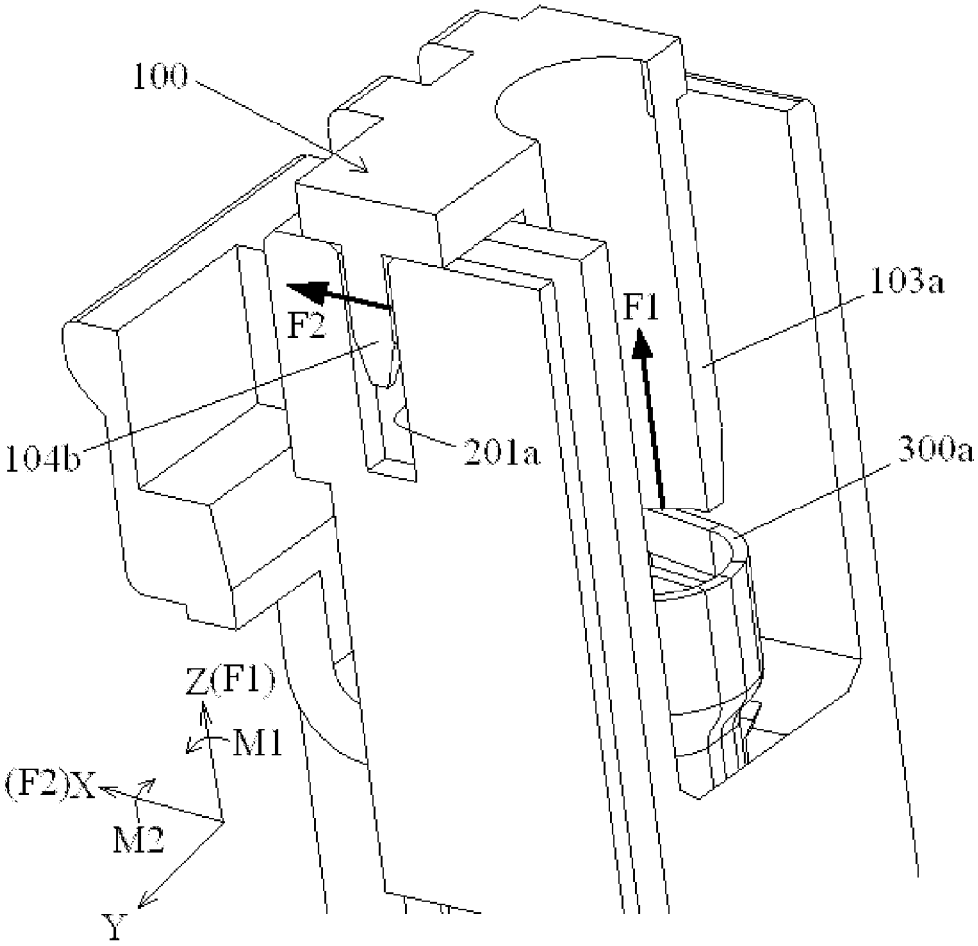
FIG. 6 is another enlarged sectional view of the rotation prevention in FIG. 5, showing how the rotation prevention member prevents the lock from being rotated outward.

Accordingly, when the cable inserted into one of the cable passage 105*a*, 105*b* is pulled outward in the direction Z, a pulling force F1 or a rotation moment M1 is exerted on the pressing rod 103*a* or 103*b* of the lock 100 through the cable as shown in FIG. 6. Meanwhile, the rotation prevention members 104*a*, 104*b* each tightly abuts against the pair of facing wall surfaces 201*a*, 201*b* of the respective recess 204*a*, 204*b* in a substantially gapless manner, a reaction force F2 or a reaction rotation moment M2 opposed to the rotation moment M1 is exerted on the rotation prevention members 104*a*, 104*b* of the lock 100 using the pair of facing wall surfaces 201*a*, 201*b* of the recesses 204*a*, 204*b* as shown in FIG. 6. In this way, the rotation moment M1 exerted on the pressing rods 103*a*, 103*b* is offset by the reaction rotation moment M2 exerted on the rotation prevention members 104*a*, 104*b* and is not transmitted to the locking pieces 102*a*, 102*b* of the lock 100. That is to say, since the rotation prevention members 104*a*, 104*b* each tightly abuts against the pair of facing wall surfaces 201*a*, 201*b* of the respective recess 204*a*, 204*b* in a substantially gapless manner, the lock 100 is prevented from being offset from or rotated with respect to the direction Z. Accordingly, the invention can effectively protect the locking pieces 102*a*, 102*b* from being damaged under the rotation moment M1.

Figure 5:
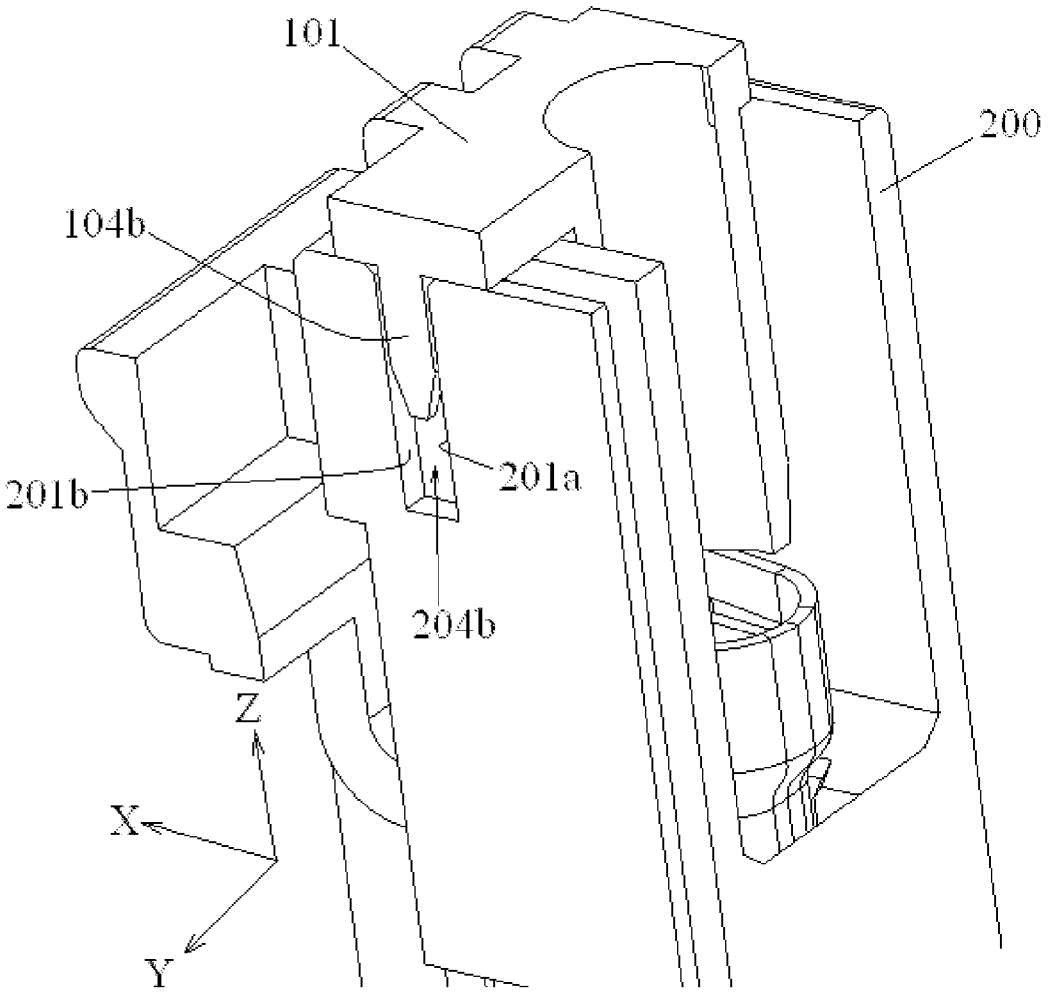
FIG. 5 is an enlarged sectional view showing a rotation prevention member of the lock mated with a recess of the housing.

Furthermore, as shown in FIGS. 1-2 and 5, in another shown embodiment of the invention, the two rotation prevention members 104*a*, 104*b* are separated by a gap 104*c* there between, and the two recesses 204*a*, 204*b* are separated by the wall 204*c* there between. When the lock 100 is mounted to the housing 200 in a snap-fit manner, the wall 204*c* between the two recesses 204*a*, 204*b* is mated with the gap 104*c* between the two rotation prevention members 104*a*, 104*b* in a substantially gapless or tightly contact manner. In this way, it can further prevent the lock 100 from being overturned outward.

In addition, as shown in FIGS. 1-2, in another shown embodiment of the invention, the rotation prevention members 104*a*, 104*b* each has a length in the vertical direction Y less than that of the locking piece 102*a*, 102*b* in the vertical direction Y, which can increases the anti-bending strength of the rotation prevention members 104*a*, 104*b*. However, the invention is not limited to this, the rotation prevention members 104*a*, 104*b* may be thickened to increase the anti-bending strength.

Although several shown embodiments have been illustrated and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electrical connector comprising:

a housing having a first receiving chamber and first recess positioned adjacent to the first receiving chamber;

a first terminal insertable into the first receiving chamber; and a lock securable to the housing and having:

a horizontal base plate;

a first pressing rod extending downward from the horizontal base plate and insertable into the first receiving chamber to urge the first terminal; and a first rotation prevention member extending downward from the horizontal base plate, insertable into the first recess to mate with the recess in a substantially gapless manner, and positioned away from the terminal.

2. The electrical connector according to claim 1, wherein the lock further includes a first locking piece extending downward from the horizontal base plate and separated from the first pressing rod.

3. The electrical connector according to claim 2, wherein the housing further includes a first slot separated from the first receiving chamber.

4. The electrical connector according to claim 3, wherein the first locking piece snap fits into the first slot.

5. The electrical connector according to claim 4, wherein the first rotation prevention member is positioned between the first pressing rod and the first locking piece.

6. The electrical connector according to claim 5, wherein the first recess includes a pair of facing wall surfaces positioned substantially parallel to each other.

7. The electrical connector according to claim 6, wherein the first rotation prevention member is mated with the pair of facing wall surfaces in a substantially gapless manner when the first rotation prevention member is positioned in the first recess.

8. The electrical connector according to claim 7, wherein the lock further includes a second rotation prevention member separated from the first rotation prevention member by a gap there between.

9. The electrical connector according to claim 8, wherein the housing includes a second recesses separated from the first recess by a wall there between.

10. The electrical connector according to claim 9, wherein the wall is insertable into the gap.

11. The electrical connector according to claim 10, wherein the lock further includes a second pressing rod extending from the horizontal base plate and separately arranged from the first pressing rod.

12. The electrical connector according to claim 11, wherein the lock further includes a second locking piece extending from the horizontal base plate and separately arranged from the first locking piece and the second pressing rod.

13. The electrical connector according to claim 12, wherein the first rotation prevention member has a length less than a length of the first locking piece.

14. The electrical connector according to claim 1, wherein the housing further includes a second receiving chamber positioned adjacent to the first receiving chamber with the first recess positioned between the first receiving chamber and the second receiving chamber.

15. The electrical connector according to claim 14, wherein the housing further includes a second recess positioned adjacent to the first recess between the first receiving chamber and the second receiving chamber.

16. The electrical connector according to claim 15, wherein the housing further includes a wall positioned between the first recess and the second recess.

17. The electrical connector according to claim 16, wherein the lock further includes a second pressing rod extending downward from the horizontal base plate and insertable into the second receiving chamber.

18. The electrical connector according to claim 17, wherein the lock further includes a second rotation prevention member extending downward from the horizontal base plate and insertable into the second recess.

19. The electrical connector according to claim 18, wherein the first rotation prevention member is separated from the second rotation prevention member by a gap there between.

20. The electrical connector according to claim 19, wherein the wall is insertable into the gap.

21. The electrical connector according to claim 20, wherein the lock further includes a second locking piece extending downward from the horizontal base plate and separated from the second pressing rod and the second rotation prevention member.

22. The electrical connector according to claim 1, wherein the first pressing rod has a semi cylindrical shape.

23. An electrical connector comprising:

a housing having a first receiving chamber, and a first recess positioned within the first receiving chamber;

a first terminal insertable into the first receiving chamber; and a lock securable to the housing and having:

a base plate extending perpendicular to an insertion direction, a first pressing rod extending orthogonally from the base plate in the insertion direction and insertable into the first receiving chamber to urge the first terminal, and a first rotation prevention member extending orthogonally from the base plate and insertable into the first recess to mate with the recess in a substantially gapless manner.

24. An electrical connector comprising:

a housing having a first receiving chamber, and a first recess positioned within the first receiving chamber;

a first terminal insertable into the first receiving chamber; and a lock securable to the housing and having:

a base plate extending perpendicular to an insertion direction, a first pressing rod extending orthogonally from the base plate in the insertion direction and insertable into the first receiving chamber to urge the first terminal, a first rotation prevention member extending orthogonally from the base plate and insertable into the first recess to mate with the recess in a substantially gapless manner, and a first locking piece extending orthogonally from the base plate in the insertion direction and parallel to the first pressing rod.

25. An electrical connector comprising:

a housing having a first receiving chamber, a first recess positioned adjacent to the first receiving chamber and extending therein;

a first terminal insertable into the first receiving chamber; and a lock securable to the housing and having:

a base plate extending perpendicular to an insertion direction;

a first pressing rod extending orthogonally from the base plate in the insertion direction and insertable into the first receiving chamber to urge the first terminal; and a first rotation prevention member extending orthogonally from the base plate and insertable into the first recess to mate with the recess in a substantially gapless manner.

* * * * *